United States Patent [19]

Muraji et al.

[11] Patent Number: 4,971,013

[45] Date of Patent: Nov. 20, 1990

[54] FUEL INJECTION DEVICE FOR INJECTION CARBURETORS

[75] Inventors: Tetsuo Muraji; Mitsuru Sekiya, both of Odawara, Japan

[73] Assignee: Mikuni Kogyo Kabushiki Kaisha, Tokyo, Japan

[21] Appl. No.: 352,300

[22] Filed: May 16, 1989

[51] Int. Cl.[5] ..... F02M 39/00

[52] U.S. Cl. ..... 123/463; 123/452

[58] Field of Search ..... 123/463, 452, 453–455, 123/464

[56] References Cited

U.S. PATENT DOCUMENTS

| | | | |
|---|---|---|---|
| Re. 25,672 | 10/1964 | Armstrong | 123/463 |
| 2,297,918 | 10/1942 | Schorn | 123/455 |
| 2,378,036 | 6/1945 | Reggio | 123/463 |
| 2,426,153 | 8/1947 | Mock | 123/464 |
| 2,438,662 | 3/1948 | Greenland | 123/463 |
| 2,438,663 | 3/1948 | Greenland | 123/464 |
| 2,957,464 | 10/1960 | Dolza | 123/455 |
| 4,294,213 | 10/1981 | Sumiyoshi | 123/454 |
| 4,421,089 | 12/1983 | Moore | 123/455 |

*Primary Examiner*—Carl Stuart Miller

*Attorney, Agent, or Firm*—Lalos & Keegan

[57] ABSTRACT

The fuel injection device for injection carburetors is provided with a single fuel control unit for injecting a fuel into a suction tube in quantities corresponding to flow rates of air to be drawn into the suction tube, a slow negative pressure passage communicating with a depression chamber of the fuel control unit, a diaphragm valve for opening a main negative pressure passage to communicate the depression chamber with the main negative pressure passage when the air suction rate exceeds a predetermined value, and another diaphragm valve operable to close a slow jet and open a main jet when the air suction rate exceeds the predetermined value. This fuel injection device is simple in the structure thereof, manufacturable at a low cost and has high fuel control accuracy.

6 Claims, 2 Drawing Sheets

FUEL INJECTION DEVICE FOR INJECTION CARBURETORS

BACKGROUND OF THE INVENTION (a) Field of the invention:

The present invention relates to a mechanical fuel injection device for injection carburetors capable of adequately adjusting fuel injection rate on the basis of negative pressure produced depending on flow rate of air to be aspirated.

(b) Description of the prior art:

A fuel injection device of this type has already been proposed by the inventor et al. of the present application. This fuel injection device will be described below with reference to FIG. 1. The fuel injection device consists of an air section of regulator 2 and a fuel section of regulator 3 which are arranged opposedly to each other on both the sides of a suction tube 1 of a carburetor. The interior of the air section of regulator 2 is devided by a first diaphragm 4 into a depression chamber 5 into which negative pressure is applied through the venturi of the carburetor and an air chamber 6 which is communicated with atmosphere. On the other hand, the interior of the fuel section of regulator 3 is divided by a second diaphragm 7 into a fuel pressure chamber 8 into which a fuel is supplied and a fuel injection chamber 9. The fuel pressure chamber 8 and the fuel injection chamber 9 are communicated with each other through an orifice or metering jet 10. The first diaphragm 4 and the second diaphragm 7 are connected to each other by a connecting member extending across the suction tube 1, and formed on the connecting member 11 is a fuel injection valve 11*a* which is capable of opening and closing a fuel injection port 9*a* formed in the fuel injection chamber 9 for adjusting the degree of said port.

This fuel injection device functions as described below. When the engine starts and air is drawn into the suction tube 1, negative pressure of a level corresponding to the air flow rate is produced in the venturi. Under this negative pressure, the first diaphragm 4 is displaced and the connecting member 11 is shifted together therewith, thereby opening the fuel injection port 9*a*. Since the degree of opening of the fuel injection port 9*a* is determined by the degree of displacement of the first diaphragm 4 or the connecting member 11, the fuel is ejected from the fuel injection port 9*a* in a quantity corresponding to the air flow rate. So long as the air flow rate remains constant, the air section of regulator 2 is balanced with the fuel section of regulator 3 in this condition and the fuel is continuously ejected at the rate determined as described above.

This mechanical conventional fuel injection device requires, for enchanced fuel control accuracy, a large and high precision fuel control unit which consists of the air section of the regulator, the fuel section of the regulator and the connecting member, and when the fuel injection system has the conventional structure, it must be equipped with a fuel control unit adapted for controlling low fuel flow rates in a slow driving range and another fuel control unit adapted for controlling high fuel flow rates in a main driving range, thereby presenting problems in that the fuel injection device is inevitably enlarged in the structure and that manufacturing cost for the fuel injection device becomes expensive.

SUMMARY OF THE INVENTION

In view of the problems described above, it is a primary object of the present invention to provide a compact mechanical fuel injection device for inJection carburetorS which is simple in structure, manufacturable at a low cost and highly effective in control accuracy.

According to the present invention, this object is accomplished by equipping fuel inJection device with a single fuel control unit capable of injecting a fuel into the suction tube in a quantity corresponding to a flow rate of air to be aspirated into the suction tube, a slow air flow rate detecting means, a main air flow rate detecting means, a slow fuel flow rate metering means, a main fuel flow rate metering means and a switching means for controlling whether the slow air flow rate detecting means and the slow fuel flow rate metering means or the main air flow rate detecting means and the main fuel flow rate metering means are to be actuated.

According to the present invention, the fuel is ejected from the fuel control unit into the suction tube in a quantity metered by the slow fuel flow rate metering means in accordance with a suction air flow rate detected by the slow air flow rate detecting means when the slow driving range is selected by the switching means, whereas the fuel is ejected from the fuel control unit into the suction tube in a quantity metered by the main fuel metering means in accordance with a suction air flow rate detected by the main air flow rate detecting means when the main driving speed range is selected by the switching means.

In a preferred formation of the present invention, the fuel control unit is composed of an air section of the regulator and a fuel section of the regulator. The air section of the regulator consists of a depression chamber and an atmospheric chamber separated from each other by a first diaphragm, the depression chamber being communicated alternatively with the venturi of the suction tube or the slow air flow rate detecting means, and the atmospheric chamber being communicated with atmosphere, whereas the fuel section of the regulator consists of a fuel pressure chamber and a fuel injection chamber separated from each other by a second diaphragm and communicated with each other through a pilot jet or a main jet to be used alternatively, the fuel pressure chamber being communicated with a fuel supply source and the fuel injection chamber having a fuel injection port capable of being communicated with the suction tube. The first diaphragm and the second diaphragm ar connected to each other by a connecting member equipped with a fuel injection valve for ejecting the fuel from the fuel injection chamber into the suction tube in cooperation with the fuel injection port. The connecting member is biased in the opposite directions by a first spring urging the fuel injection valve to open the fuel injection port, and a second spring having spring rate higher than that of the first spring and urging the fuel injection valve to close the fuel injection port.

In another preferred embodiment of the present invention, the slow fuel flow rate metering means comprises a pilot jet arranged in a communication passage capable of communicating the fuel pressure chamber with the fuel injection chamber and an additional pilot jet arranged in a branch passage bypassing the pilot jet, whereas the main fuel flow rate metering means comprises a main jet arranged in the communication passage and an additional main jet arranged in the branch passage. The pilot Jet or the main jet is selected for operation by the switching means. In addition, arranged in the branch passage is a solenoid valve to be duty-controlled.

In a third preferred embodiment of the present invention, the switching means comprises three diaphragm valves which are switched all together when the negative pressure produced in the suction tube exceeds a certain predetermined level. The first diaphragm valve is switched to communicate the depression chamber of the air section of the regulator with the venturi in the suction tube, the second diaphragm valve is switched so that the main jet is to be used and the third diaphragm valve is switched so that the additional main jet is to be used.

This and other objects as well as other features and advantages of the present invention will become apparent from the following detailed description of the preferred embodiment when taken in conjunction with the accompanying drawings.

DESCRIPTION OF THE PREFERRED EMBODIMENT

Figure 1:
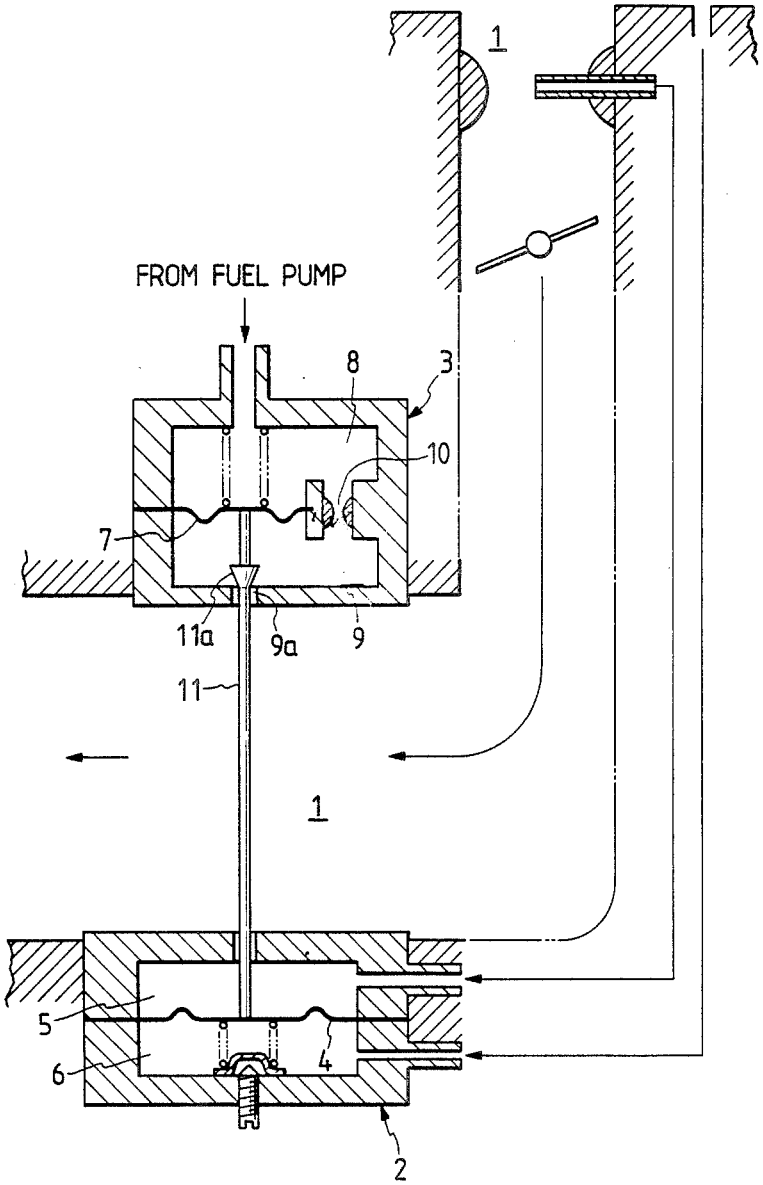
FIG. 1 PRIOR ART
FIG. 1 is a schematic sectional view illustrating an example of the conventional fuel injection devices for injection carburetors.

Now, an embodiment of the present invention will be described below with reference to FIG. 2. In this drawing, the reference numeral 1 represents a suction tube of a carburetor, the reference numeral 12 designates an air valve arranged in the open position at a location downstream a venturi 13 in the suction tube 1, and the reference numeral 14 denotes a limit stop for preventing the suction tube 1 from being completely closed by the air valve 12 and so formed as to leave narrow gaps 15*a* and 15*b* between the outer circumferential edge of the air valve 12 and the inside wall of the suction tube 1 in the condition of the minimum opening degree (initial opening degree) where the air valve 12 is engaged with the limit stop 14. The reference numeral 16 represents a throttle valve arranged at a location downstream the air valve 12.

The reference numeral 17 represents a diaphragm separating a depression chamber 18 from an atmospheric chamber 19 and connected to a lever 12*a* attached fixedly to the rotating shaft of the air valve 12, the reference numeral 20 designates a spring biasing the diaphragm 17 rightward (toward the atmospheric chamber 19), the reference numeral 21 denotes a passage having one end opening 21*a* located downstream the gap 15*b* formed in the suction tube 1 and the other end opening communicated with the depression chamber 18 through an orifice 21*b*, these members comprising a negative pressure actuator 22 which controls the degree of opening of the air valve 12 by displacing the diaphragm 17 while applying the negative pressure produced downstream of gap 15*b* in the depression chamber 18. The reference numeral 23 represents a control valve which divides, by a diaphragm 25, a depression chamber 24 communicated with the passage 21 at a location upstream the orifice 21*b* and functions to control inflow of atmosphere into the depression chamber 18 of the negative pressure actuator 22 through a leak valve 23*a* by displacing the diaphragm 25 in accordance with level of the negative pressure applied to the depression chamber 24.

The reference numeral 26 represents a first bypass passage capable of communicating the upstream side with the downstream side of the throttle valve 16 through an orifice 26*a*, the reference numeral 27 designates a starting air valve arranged in the first bypass passage at a location downstream of the orifice 26*a*, and functioning to open the passage 26 for starting the engine at low temperatures but to close the passage as temperature rises, the reference numeral 28 denotes a second bypass passage communicating the upstream side of the orifice 26*a* in the first bypass passage 26 with the downstream side of the starting air valve 27 through an orifice 28*a*, the reference numeral 29 represents an idle speed control (ISC) valve arranged in the course of the second bypass passage 28 and functioning to control idling speed of the engine through control of air flow rate, the reference numeral 30 designates a third bypass passage for further bypassing the second bypass passage, and the reference numeral 31 denotes a needle valve shiftably inserted under a biasing force applied by a bimetal 32 through a valve port arranged in the course of the third bypass passage 30. The needle valve 31 is so adapted as to open the third bypass passage 30 to flow air for opening the starting air valve 27 when the engine is to be started at low temperatures, but allow the third bypass passage 30 to be closed due to leftward flexture of the bimetal 32 for closing the starting air valve 27 as temperature rises.

The reference numeral 33 represents a fuel control unit having the same function as that of the conventional fuel control unit and the reference numeral 34 disignates an air section of regulator. The air section of regulator 34 is divided by a first diaphragm 35 into a depression chamber 36 and an atmosphere chamber 37 which contains a spring 37*a* for urging the first diaphragm 35 upward (toward the depression chamber 36) and an adjusting screw 38 capable of adjusting the spring load of the spring 37*a* by way of a spring support 38*a*. The reference numeral 39 represents a main negative pressure passage communicated through the venturi 13 with the suction tube 1, or a main air flow rate detector, the reference numeral 40 designates a subsidiary negative pressure passage communicated with the suction tube 1 at a location downstream the gap 15*a*, or a slow air flow rate detector, the reference numeral 41 denotes a negative pressure introduction passage for communicating a confluence chamber 41*a* joining the negative pressure passages 39 and 40 with the depression chamber 36 through an orifice, and the reference numeral 42 represents a first switching valve for opening and closing the main negative pressure passage 39 in accordance with the negative pressure in the air section of regulator 22. This switching valve 42 consists of an atmospheric chamber 44 and a depression chamber 42 separated from each other by a diaphragm 43, a valve member connected to the diaphragm 43, and a spring 45*a* arranged in the depression chamber 45 for urging the valve member in the direction to close the main negative pressure passage 39. The first switching valve 42 is so adapted as to close the main negative pressure passage 39 in the slow driving range and open the main negative pressure passage 39 in the main driving range. The reference numeral 46 represents a negative pressure passage for communicating the depression chamber 18 of the negative pressure actuator 22 with the depression chamber 45 of the first switching valve 42 through an orifice 46*a*. The reference numeral 47 represents a negative pressure introduction passage for communicating the second bypass passage 28 located upstream the ISC valve 29 with the depression chamber 36 in the air section of regulator 34 through orifice 47*a* and the reference numeral 48 designates a negative pressure switching valve which is located downstream the orifice 47*a* in the negative pressure introduction passage 47, functions to open and close the passage 47 in accordance with the negative pressure introduced through intake ports 49*a* and 49*b* located upstream and downstream of the throttle valve 16, and is adapted to be capable of introducing the negative pressure from the second bypass passage 28 into the depression chamber 36 of the air section of regulator 34.

The reference numeral 50 represents a fuel section of regulator 33 which is divided by a second diaphragm 51 into a fuel pressure chamber 52 and a fuel injection chamber 53. Arranged in the fuel pressure chamber is a spring 52*a* for biasing the second diaphragm 51 toward the fuel injection chamber 53. The reference numeral 54 represents a fuel passage which communicates the fuel pressure chamber 52 with the fuel injection chamber 53, and has branch passages 54*a* and 54*b* bypassed in the course thereof, the reference numerals 55*a* and 55*b* denote a pilot jet and a main jet arranged as fuel metering members in the branch passages 54*a* and 54*b* respectively, and the reference numeral 56 represents a second switching valve which has the structure and function similar to those of the first switching valve 42, and is adapted to close the branch passage 54*b* including the main jet 55*b* in the slow driving range and close the branch passage 54*a* including the pilot jet 55*a* in the main driving range. The reference numeral 57 represents a fuel bypass passage which communicates the upstream side with the downstream side of the branch passages 54*a* and 54*b* of the fuel passage 54, and has branch passages 57*a* and 57*b* bypassed in the course thereof, the reference numerals 58*a* and 58*b* denote a pilot jet and a main jet which are arranged as fuel metering members in the branch passages 57*a* and 57*b* respectively, and the reference numeral 59 designates a third switching valve which has the structure and function similar to those of the first switching valve 42, and is adapted to close the branch passage 57*b* comprising the main jet 58*b* in the slow driving range and close the branch passage 57*a* including the pilot jet in the main driving range. The reference numeral 60 represents a solenoid valve which is arranged in the fuel bypass passage 57 at a location downstream the branch passages 57*a* and 57*b* and subjected to duty-control by a control circuit (not shown) to adjust flow rate of the fuel supplied from the fuel pressure chamber 52 through the fuel passage 54 into the fuel injection chamber 53, thereby controlling the air-fuel ratio of the mixture to be supplied to the engine. The reference numeral 61 represents a fuel passage for supplying fuel from a fuel tank 63 into the fuel pressure chamber 52 by a fuel pump 62 arranged in the course of said fuel passage 61, and the reference numeral 64 designates a fuel adjusting valve communicated with the fuel pressure chamber 52 and the fuel tank 63 respectively through passages 64*a* and 64*b*, and adapted to maintain fuel pressure at a predetermined level in the fuel pressure chamber 52 and return excessive quantity of the fuel into the fuel tank 63. The reference numeral 65 represents a fuel injection passage for communicating the fuel injection port 53*a* of the fuel injection chamber 53 with the suction tube 1 at a location downstream the throttle valve 16.

The reference numeral 66 represents a connecting member for connecting the first diaphragm 53 in the air section of the regulator 34 to the second diaphragm 51 in the fuel section of regulator 50, and the reference numeral 66*a* designates a needle valve which is formed integrally with the connecting member 66, and functions to control quantity of the fuel to be injected into the suction tube 1 by opening and closing the fuel injection port 53*a* in accordance with movement of the connecting member 66. This needle valve 66*a* closes the fuel injection port 53*a* while internal pressure is equal between the depression chamber 36 and the atmospheric chamber 37, or the engine is rested.

Now, functions of the embodiment will be described below.

Figure 2:
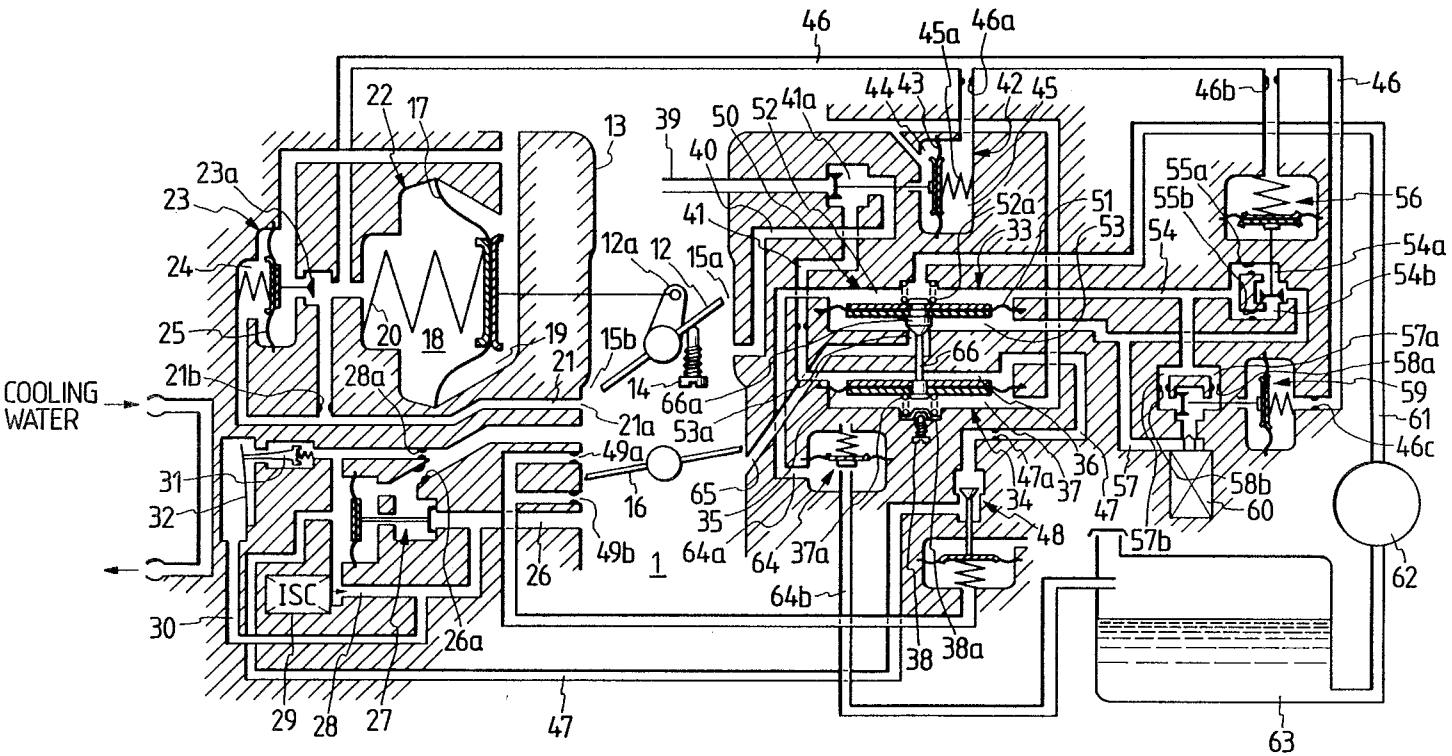
FIG. 2 is a schematic sectional view illustrating an embodiment of the fuel injection device for injection carburetors according to the present invention.

In the slow driving range just after the engine is started, the air valve 12 is set at the initial opening degree shown in FIG. 2 and the throttle valve 16 is opened a small amount, whereby a certain level of negative pressure is produced on the side downstream the gaps 15*a* and 15*b*. This negative pressure is applied to the depression chamber 24 of the control valve 23 through the passage 21 but, since the negative pressure is very low, the control valve 23 does not operate and the leak valve 23*a* is kept in the open condition. On the other hand, this negative pressure is applied also into the depression chamber 18 of the negative pressure actuator 22 through the orifice 21*b* but, since the leak valve 23*a* is kept in the open condition, the negative pressure actuator 22 does not operate and the air valve 12 is kept at the initial opening degree. Further, the negative pressure of the depression chamber 18 is applied to the depression chamber 45 of the first switching valve 42 through the passage 46, but the first switching valve 42 also operates to maintain the main negative pressure passage 39 in the closed condition. Similarly, the second switching valve 56 and the third switching valve 59 also maintain the branch passage 54*b* including the main jet 55*b* and the branch passage 57*b* including the main jet 58*b* in the close conditions respectively. Since the negative pressure produced downstream of the gap 15*a* of the air valve 12 is applied to the depression chamber 36 of the air section of regulator 34 through the confluence chamber 41*a* of the subsidiary negative pressure passage 40 and the negative pressure introduction passage 41 in the conditions described above, the first diaphragm 35 and the connecting member 66 are displaced upward. Then, the second diaphragm 51 is displaced also upward and the needle valve 66*a* opens the fuel injection port 43, whereby the fuel is ejected from the fuel injection chamber 53 into the suction tube 1 through the fuel injection port 53*a* and the fuel injection passage 65. Accordingly, the fuel pressure is lowered in the fuel injection chamber 53, and the fuel is supplied in a quantity corresponding to the ejection rate from the fuel pressure chamber 52 into the fuel injection chamber 53 through the fuel passage 54 and the pilot jet 55*a*. Further, the fuel to be fed into the fuel injection chamber 53 through the fuel bypass passage 57 and the pilot jet 58*a* is adjusted in quantity thereof by the solenoid valve 60 and then is supplied additionally into the fuel injection chamber 53 for adequately controlling the air-fuel ratio of the mixture to be fed to the engine by adjusting the total fuel flow rate. Accordingly, the force biasing the connecting member 66 upward is balanced with the force biasing the connecting member 66 downward and the needle valve 66a is kept at the same degree of opening so long as the negative pressure remains constant downstream the gap 15a. Then, as the flow rate of the air to be drawn into the suction tube 1 is increased and the negative pressure applied to the depression chamber 36 is enhanced, the connecting member 66 is displaced further upward and the fuel is injected at a higher rate into the suction tube 1 through the fuel injection port 53a and the fuel injection passage 65. As a result, accurate fuel injection rates are obtained in accordance with the air flow rates downstream of the gaps 15a and 15b in the suction tube 1, and the air-fuel ratio of the mixture to be supplied to the engine is adequately controlled in the slow driving range.

When the throttle valve 16 is opened more widely, the air flow rate is enhanced in the suction tube 1 and the negative pressure applied through the intake opening 21a to the depression chamber 24 of the control valve 23 is further increased. When the negative pressure exceeds a predetermined level, the control valve 23 operates to close the leak valve 23a and atmospheric air stops flowing into the depression chamber 18 of the negative pressure actuator 22. Then, the depression chamber 18 is set at the same negative pressure as that in the intake opening 21a and the negative pressure actuator 22 operates to turn the air valve 12 counterclockwise from the initial opening position, thereby shifting the engine into the main driving range. This negative pressure in the depression chamber 18 is applied through the passage 46 into the first, second and third switching valves 42, 56 and 59 for operating these valves. By the operation of the first switching valve 42, the main negative pressure passage 39 is opened to apply the negative pressure from the main venturi 13 into the depression chamber 36 of the air section of regulator 34 and the connecting member 66 is displaced so as to allow the needle valve 66a to increase the opening degree of the fuel injection port 53a. Further, by the operation of the second switching valve 56, the pilot jet 54a is closed in the fuel passage 54 and the fuel is fed into the fuel injection chamber 53 through the main jet 54b. By the operation of the third switching valve 59, the pilot jet 58a is closed in the fuel bypass passage 57 and the fuel is supplied into the fuel injection chamber 53 through the main jet 58b. Accordingly, the quantity of the fuel injected from the fuel injection port 53a of the fuel injection chamber 53 through the fuel injection passage 65 is determined in accordance with the air flow rate in the suction tube 1, the fuel is supplied in a predetermined quantity from the fuel pressure chamber 52 into the fuel injection chamber 53 and the air fuel ratio of the mixture to be supplied to the engine is controlled adequately in the main driving range.

As is understood from the foregoing description, the embodiment of the present invention makes it possible to accurately control fuel injection rates in both the slow driving range and the main driving range, and adequately control the air-fuel ratio of the mixture with the single fuel control unit 33. Further, the air flow rate metering members and the fuel metering members for feeding the fuel into the fuel injection chamber 53 are adapted to be selected by the switching valves for the slow driving range or the main driving range, and need not be of high precision type. Accordingly, the present invention makes it possible to design a compacter fuel injection device and reduce manufacturing cost thereof.

What is claimed is:

1. A fuel injection device for injection carburetors comprising:

a single fuel control for injecting a fuel into a suction tube in quantities corresponding to flow rates of air drawn into the suction tube;

a slow air flow rate detecting means communicating with said suction tube;

a main air flow rate detecting means communicating with said suction tube;

a slow fuel metering means;

a main fuel metering means;

said fuel control unit including an air section of a regulator consisting of a depression chamber and an atmospheric chamber separated from each other by a first diaphragm, said depression chamber being communicable with said slow and main air flow rate detecting means, and said atmospheric chamber communicating with the atmosphere;

said fuel control unit including a fuel section of said regulator consisting of a fuel pressure chamber and a fuel injection chamber separated from each other by a second diaphragm and communicable with each other through said slow and main fuel metering means, said fuel pressure chamber being communicable with a fuel supply source, and said fuel injection chamber having a fuel injection port communicating with said suction tube;

said fuel control unit including a connecting member connected to said first diaphragm and said second diaphragm, and provided with a fuel injection valve operable to open and close said fuel injection port;

said fuel control unit including a first means operable for biasing said connecting member so that said fuel injection valve will be biased in an open condition relative to said fuel injection port, and a second means having a biasing rate greater than that of said first biasing means operable for biasing said connecting member so that said fuel injection valve will be biased in a closed condition relative to said fuel injection port; and switching means operatively connected to said slow and main airflow rate detecting means and said slow and main fuel metering means, for rendering effective said main air flow rate metering means and said main fuel metering means when said air flow exceeds a predetermined value.

2. A fuel injection device for injection carburetors according to claim 1 wherein said slow fuel metering means consists of a first pilot jet arranged in a communication passage capable of communicating said fuel pressure chamber with said fuel injection chamber and a second pilot jet arranged in a branch passage bypassing said first pilot jet, said main fuel metering means consists of a first main jet arranged in said communication passage and a second main jet arranged in said branch passage, said first pilot jet and said first main jet are adapted to be used alteratively by said switching means, and said second pilot jet and said second main jet are adapted to be used alternatively by said switching means.

3. A fuel injection device for injection carburetors according to claim 2 further comprising a solenoid valve for adjusting flow rate of the fuel passing through said branch passage.

4. A fuel injection divice for injection carburetors according to claim 1 or 2 wherein said fuel injection device further comprises an air valve arranged downstream a venturi in said suction tube and capable of being kept at a minimum opening degree in a slow driving range, said slow air flow rate detecting means consists of a first negative pressure passage having an end communicated with said suction tube at a location downstream said air valve and the other end communicated with said depression chamber, and said main air flow rate detecting means consists of a second negative pressure passage having an end communicated with the venturi in said suction tube and the other end openable by said switching means for communication with said depression chamber.

5. A fuel injection device for injection carburetors according to claim 4 wherein said switching means consists of a first diaphragm valve for opening the other end of said second negative pressure passage to communicate said second negative pressure passage with said depression chamber, a second diaphragm valve for setting said first pilot jet and said first main jet alternatively in usable condition, and a third diaphragm valve for setting said second pilot jet and said second main jet alternatively in usable condition, and said first, second and third diaphragm valves operate all together to open said second negative pressure passage for switching said first and second main jets to usable conditions thereof when the negative pressure downstream of said air valve exceeds a predetermined level.

6. A fuel injection device for injection carburetors according to claim 5 further comprising a throttle valve arranged at a location downstream of said air valve in said suction tube, and an additional negative pressure passage having an end communicated with said suction tube at a location between said air valve and said throttle valve and the other end communicated with said depression chamber, and adapted to be capable of applying an additional negative pressure into said depression chamber only for starting at low temperatures.

* * * * *